United States Patent [19]

Chastain

[11] Patent Number: 4,548,004

[45] Date of Patent: Oct. 22, 1985

[54] SPACE FRAME CONSTRUCTION WITH MUTUALLY DEPENDENT SURFACES

[76] Inventor: Lemuel J. Chastain, Mountain Rest, S.C. 29664

[21] Appl. No.: 521,158

[22] Filed: Aug. 8, 1983

[51] Int. Cl.[4] ..... E04B 1/32

[52] U.S. Cl. ..... 52/81; 52/DIG. 10

[58] Field of Search ..... 52/80, 81, DIG. 10

[56] References Cited

U.S. PATENT DOCUMENTS

| | | | |
|---|---|---|---|
| 3,042,050 | 7/1962 | Finlayson | 52/81 |
| 3,093,461 | 6/1963 | Woolven | 52/DIG. 10 |
| 3,354,591 | 11/1967 | Fuller | 52/81 |
| 3,439,460 | 4/1969 | Allen | 52/81 |
| 3,461,574 | 8/1969 | Larsen | 52/DIG. 10 |
| 3,659,360 | 5/1972 | Zeischegg | 52/DIG. 10 |
| 3,866,366 | 2/1973 | Fuller | 52/81 |
| 3,921,349 | 11/1975 | Kolozsvary | 52/81 |

FOREIGN PATENT DOCUMENTS

| | | | |
|---|---|---|---|
| 1060867 | 3/1967 | United Kingdom | 52/81 |

OTHER PUBLICATIONS

Mathematical Models by Cundy and Rollett; ©1961, Oxford University Press; pp. 76–83, 102, 108, 116, 117, 120, 121.

*Primary Examiner*—Henry E. Raduazo

*Attorney, Agent, or Firm*—Natter & Natter

[57] ABSTRACT

A space frame construction with mutually dependent surfaces includes plural polyhedra having rigid panel members that need not be interconnected along abutting edges. The panel members of each of said polyhedra are further related to each other through duality. Interconnection between the polyhedra is achieved through bevel angle panel members, sloped web panel members, and wedge brace panel members. An optional chock may be further utilized for supplemental reinforcement.

9 Claims, 6 Drawing Figures

FIG. 3
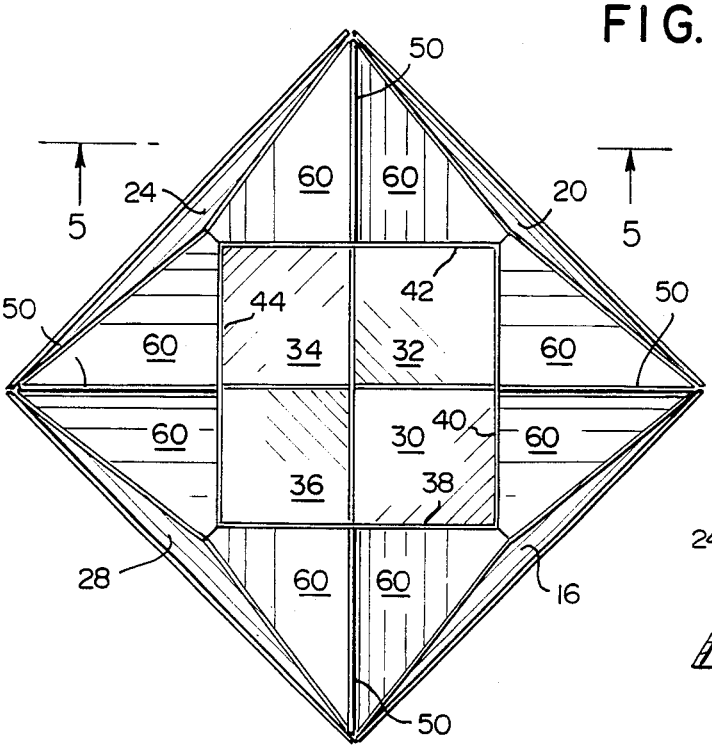
FIG. 5
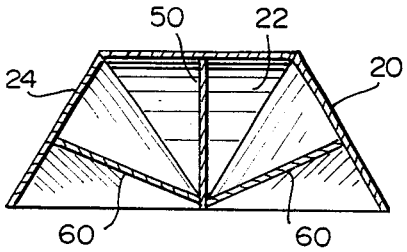
FIG. 6
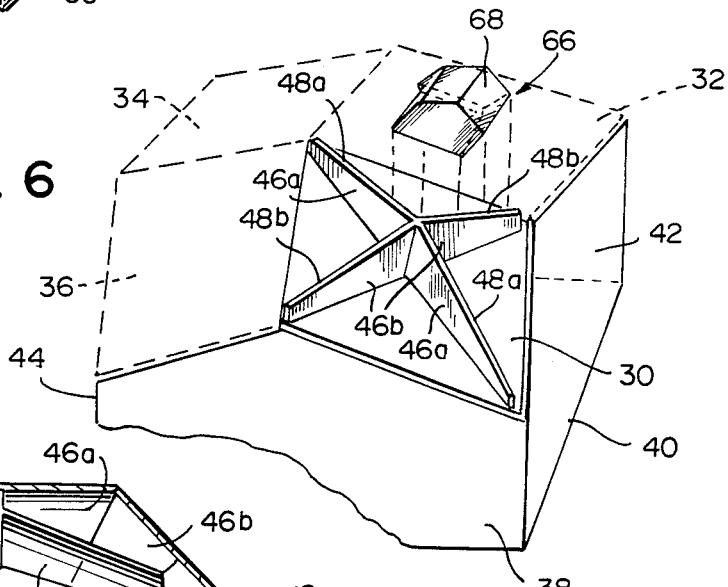
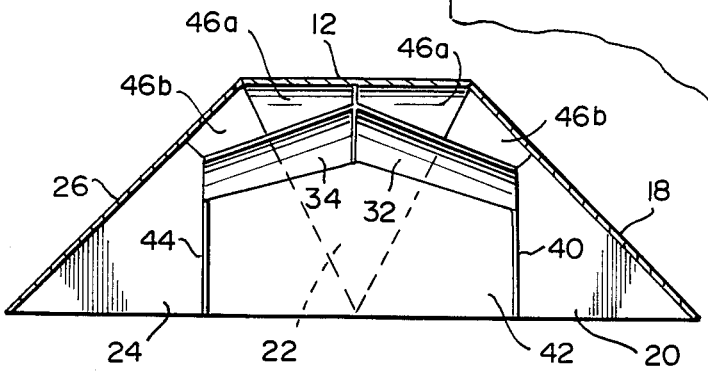
FIG. 4

SPACE FRAME CONSTRUCTION WITH MUTUALLY DEPENDENT SURFACES

TECHNICAL FIELD

This invention relates to static structures and especially to a space frame.

In particular, the space frame of this invention concerns a construction approximating a domical or other curved surface and formed by companion polyhedra having structurally interdependent panels.

BACKGROUND ART

Space enclosures having a domelike structure were generally developed to combine the desirable properties of a tetrahedron and a sphere and frequently took the form of a geodesic dome. Those constructions utilized a basic skeletal arrangement for supporting a surface covering. The framing system commonly employed a geometric network of rod elements, tubular members or struts joined at their ends by a hub or socket-node with rigid or flexible surface panels placed over that triangulated framework. A shortcoming of those dome structures was that they relied exclusively on the hubs and struts for structural rigidity. A further problem was that the hubs which connected and held the ends of the struts were subject to concentrated multiple directional forces and thus had a greater potential for stress failure both as a result of material fatigue and because of the unusual load conditions.

Another dome construction of the prior art provided for direct connection of adjacent panel edges without an underlying framework as typically illustrated in U.S. Pat. No. 3,740,903. It should be observed, however, that those systems of pre-assembly panels did not utilize surface panels as load transfer members but rather relied upon peripheral flanges which extended along the margins of each panel and functioned in a similar manner as the aforementioned skeletal framework.

Still another variation of the previous dome constructions included panel members wherein the abutting edges were interlocked such as shown in U.S. Pat. Nos. 4,180,950 and 4,287,690. A distinct limitation of those last mentioned constructions concerned the strict tolerance requirements for the precise interfitting of the panels and the inherent problems in the erection of those structures. Furthermore, all of the devices as previously discussed did not incorporate a support arrangement having two interrelated structural surfaces.

The U.S. Pavilion at Expo '67 in Montreal, Canada employed a double layer space frame to form a three-quarter sphere, double grid geodesic dome. That structure however, as illustrated in the publication, *Geodesics* by Edward Popko, ©1968, University of Detroit Press, in Fig. No. 88, consisted of a hexagonal inner layer and triangulated outer layer with a web network of tubular members joining the two layers. That geodesic dome did not use rigid surface panels as structural components.

The present invention in contrast, is derived from a topological approach to geometric forms which provides the basis for the relationship between structural incorporated surfaces.

DISCLOSURE OF THE INVENTION

The purpose of this invention is to provide a space frame construction for any mathematically definable curved surface in three-dimensional space.

Briefly, the construction, in accordance with this invention, encompasses a plurality of planar surface panels forming interrelated polyhedra which do not utilize a separate grid framing system. The inventive concept further concerns the application of the principal of duality wherein the centers of the faces of one set of polygons on one surface are placed in correspondence with the vertices of another set of polygons of another surface and vice versa.

In the disclosed embodiment, plural multifaceted planar surfaces are derived by an approximation developed from a tessellation or mosaic pattern of geodesic polygons covering a curved surface without overlapping and without leaving any gaps and from a corresponding tessellation formed on a secondary curved surface providing dual geodesic polygons. The substitution of planar polygons for the geodesic polygons on each of the curved surfaces provides two polyhedral surfaces projected normally from the respective curved sufaces and related by duality. The planar surface panels conforming to the geodesic polygons on each of the normally projected polyhedral surfaces are mutually supported by corresponding panel members on confronting polyhedral surfaces and do not require inter-surface connection along abutting edges. This is attainable for the reason that each geodesic polygon of one tessellation covers area common to several polygons of the dual. Thus a surface panel of one tessellation can be connected to several surface panels of the dual tessellation and edge connection of adjacent surface panels within the same polyhedral surface is not required-although this can be done for additional strengthening purposes.

In the present invention, the interjoining of the confronting polyhedral surfaces is accomplished by the use of intraspacial members placed at strategic locations for spanning the respective separation between the surfaces.

A feature of this construction is that the space frame is not dependent upon a network of hubs, struts or tubular members for providing a skeletal support.

An advantage, therefore, of this invention is that the surface panels are integrated into the structure for improved structural integrity rather than being used merely as a surface covering.

It should also be observed that the surface panels on any given surface need not be connected directly to any other panel on the same surface.

Another feature of this invention is that the plural polyhedra provide a multi-wall construction.

In a view of the foregoing, it should be apparent that the present invention overcomes many of the shortcomings of the prior art and provides a space frame construction that is an improvement over the previous structures.

Having thus summarized the invention, it will be seen that it is an object thereof to provide a space frame construction of the general character described herein which is not subject to the aforementioned disadvantages.

Specifically, it is an object of this invention to provide a space frame construction having plural multifaceted interdependent surfaces approximating curved surfaces and arranged in normally projected spacial relationship.

Another object of the present invention is to provide a space frame construction including confronting polyhedral surfaces wherein the polygons of the respective surfaces are related by duality.

Still another object of this invention is to provide a space frame construction wherein intraspacial support members interconnect the polygons of the respective polyhedral surfaces.

Still another object of this invention is to provide a space frame construction wherein discrete surface panels on each of the polyhedral surfaces need not be joined along abutting edges.

A further object of this invention is to provide a space frame construction having at least two interrelated wall surfaces for providing an intercellular space.

Yet another object of this invention is to provide a space frame construction which is relatively simple in construction, low in cost, reliable in use and well adapted for practical applications.

Other objects, features and advantages of the invention will in part be obvious and in part will be pointed out hereinafter.

With these ends in view, the invention finds embodiment in certain combinations of elements and arrangements of parts by which the aforementioned objects and certain other objects are hereinafter attained, all as more fully described with reference to the accompanying drawings and a scope of which is more particularly pointed out and indicated in the appended claims.

BRIEF DESCRIPTION OF THE DRAWINGS

In the accompanying drawings in which is shown a possible exemplary embodiment of the invention:

FIG. 3 is a bottom plan view to a slightly reduced scale taken substantially along line 3—3 of FIG. 1 and showing the companion polyhedron with vertical side panels and the support members;

FIG. 4 is a sectional view taken substantially along line 4—4 of FIG. 2 showing the rhombic panels and the bevel angles;

FIG. 5 is an auxiliary view taken substantially along line 5—5 of FIG. 3 illustrating the intersection of two wedge braces and a sloped web member; and FIG. 6 is an isolated perspective view of the rhombic panel showing the optional chock in exploded fashion with adjacent rhombic and pentagonal panels in phantom.

BEST MODE FOR CARRYING OUT THE INVENTION

Figure 1:
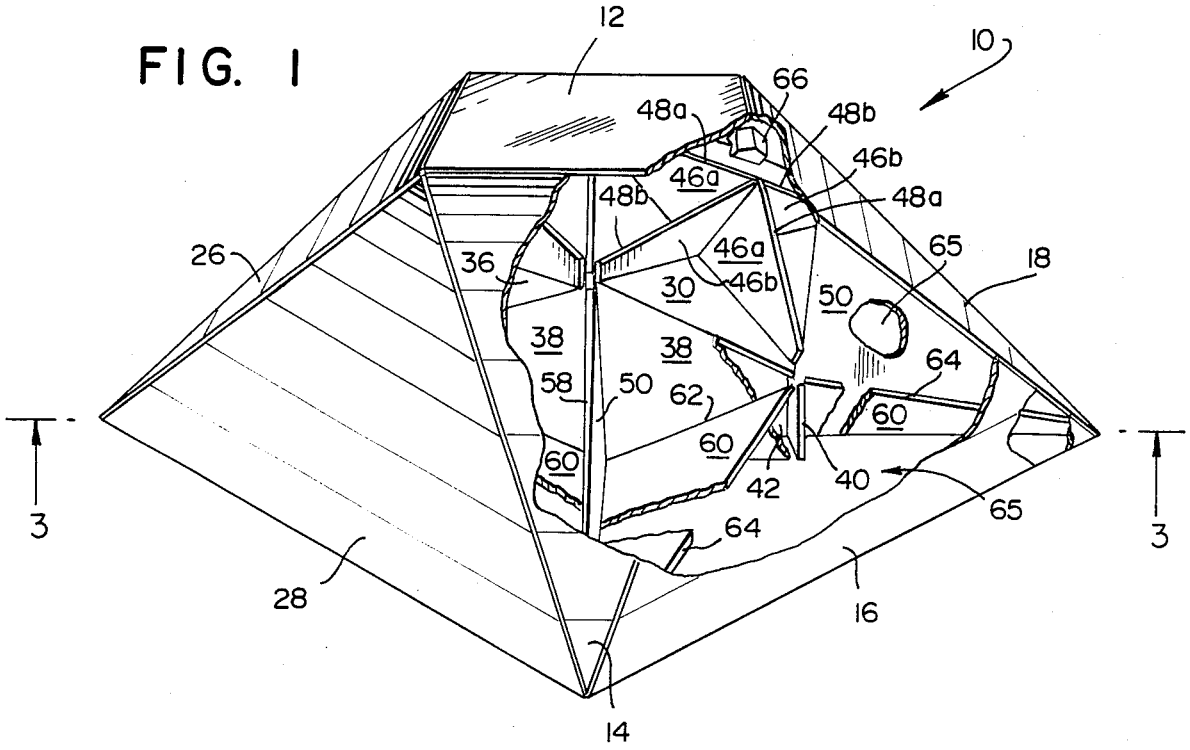
FIG. 1 is a perspective view of a hemispheric dome construction with mutually dependent surfaces in accordance with this invention, and showing an outer polyhedron having a substantially horizontal rectangular roof panel and eight side panels shaped as isosceles triangles with a portion of the roof and three side panels broken-away and exposing an underlying companion polyhedron having a set of four rhombic panels and four vertical pentagons in duality with the roof and side panels, for providing an interdependent support arrangement.

Referring now in detail to the drawings, there is illustrated in FIG. 1 a preferred embodiment of a hemispheric dome constructed with mutually dependent surfaces as denoted generally by the reference numeral 10.

The hemispheric dome 10 has been selected for the purpose of simplifying the foregoing explanation and was generated by projecting a tessellation of a hemispherical surface above and onto a plurality of approximative planar members to form a multifaceted surface defining an outer polyhedron. It should, of course, be noted that a hemispherical surface can be approximated into any number of planar polygons of different shaped faceted surfaces. Furthermore, the approach of this invention can be applied to other curved surfaces for establishing similar polyhedra.

It should also be understood that the construction of this invention has general utility as an enclosure and can be adapted for various types of buildings such as homes, greenhouses, convention centers and other structures.

Referring again to the dome construction 10, the faceted exterior surface includes a substantially rectangular shaped roof panel 12, and eight discrete triangular side panel members 14, 16, 18, 20, 22, 24, 26, 28. The roof panel 12 and the eight (even numbered) side panels 14–28 are planar members preferably made of plywood or of an equivalent type rigid structural material. In this embodiment, the side panels 14, 18, 22 and 26 are identically shaped isosceles triangles and are arranged as shown with an apex lying in a downward direction. The companion side panels 16, 20, 24 and 28 form a second set of identical isosceles triangles with their apex lying contiguous to a corner of the roof panel 12. It should also be mentioned that in accordance with this invention, the confronting edges of each of the eight (even numbered) panels 14–28 and the roof panel 12 are disjoined and do not require panel-to-panel connection along their coincident edges. Additionally, although not shown, access openings can be provided within the nine (even numbered) panels 12–28 for doors, windows or for other apertures.

An interior polyhedral surface is formed by approximating a complimentary hemispheric tessellation below the generating curved surface. This interior surface is generated as a dual tessellation in that the centers of the polygons are formed to correspond with the vertices of the (even numbered) panels 12–28. In this instance, the centers of the (even numbered) panels 14–28 is the intersection of the angle bisectors, however for the general case the center of a planar panel on the polyhedral surface will correspond to a point on the generating curved surface which point is coincident with a line projected normally to the planar panel from the curved surface. It should be further noted that strict duality is usually illustrated with interplaning of or contact points between the polyhedral surfaces, however, in this embodiment the surfaces do not intersect and for that reason intraspacial members have been introduced.

With reference to this embodiment, the dual polygons are formed as a set of four obliquely oriented rhombuses 30, 32, 34, 36. The (even numbered) rhombuses 30–36 lie above four substantially vertical pentagonal panels 38, 40, 42, 44 positioned in a rectangular periphery and defining therebetween an interior enclosure. The pentagonal panels are produced from four hexagons which would occur in a full spherical dome and have been truncated along the equatorial boundary plane for this hemispherical dome 10. The original center of the hexagon, as defined above, has been retained with regard to the duality relationships.

As previously mentioned, the (even numbered) panels 12–28 do not intersect with the (even numbered) panels 30–44 and for this reason, a plurality of intermediary or intraspacial members, hereinafter described, have been located for joining the exterior polyhedral surface with the interior polyhedral surface.

Figure 2:
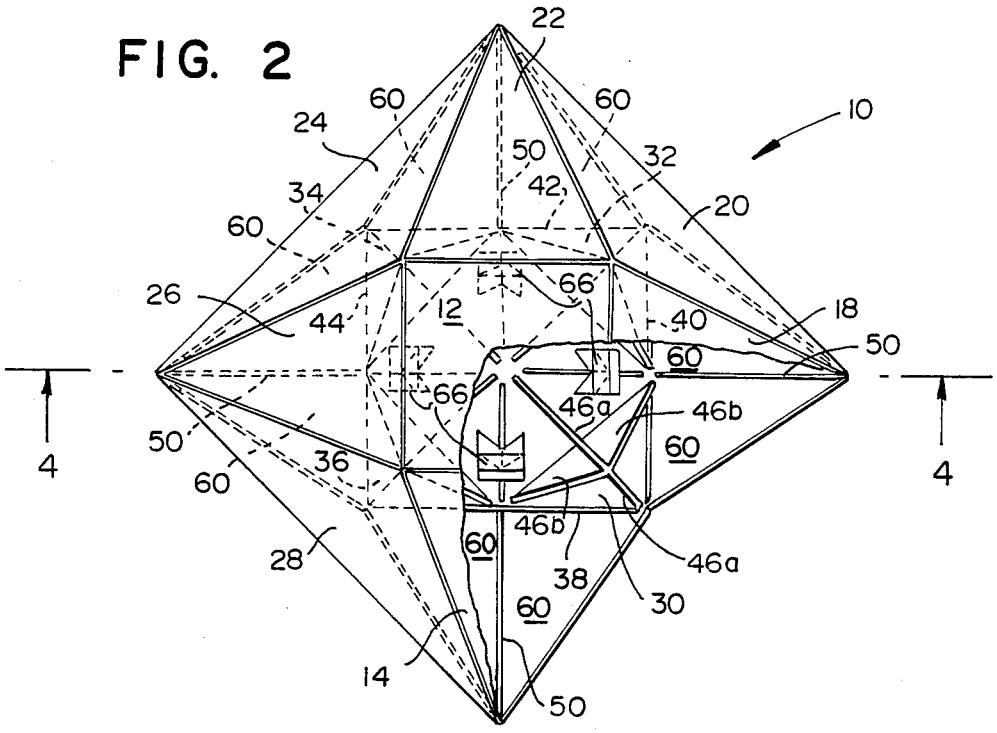
FIG. 2 is an overhead view to a slightly reduced scale of the hemispheric dome construction of FIG. 1 with a portion of the outer polyhedron removed and showing intraspacial support members including a bevel angle, a wedge brace, a sloped web member and a optional chock for supporting the roof panel and also showing symmetrically placed hidden support members in broken-line.

As best shown in FIGS. 1, 2 and 6, one specie of intraspacial member rests upon and is attached to the (even numbered) rhombus panels 30–36 and includes a set of bevel angle panel members 46*a* and 46*b*. The level angle panel members of each set 46*a* and 46*b* are quadrilateral shaped members dimensioned so as to conform to the angular space configuration between the respective polyhedral surfaces and extend from a maximum height above the center of the (even numbered) rhombus panels 30–36 to a minimum height at each corner. Furthermore, an upper edge or inclined surface 48*a*, 48*b* is buttressed against and affixed to the confronting exterior roof panel 12 and the side panels 14, 16, 18.

In order to provide additional support, another specie of intermediary member includes a sloped web panel member 50. Each of four sloped web panel members 50 have a substantially vertical side abutting against and attached to a respective (even numbered) pentagonal panel member 38–44. An inclined edge 58 of the sloped web panel member 50 is contiguously secured from the apex of each of the side panel members 14, 18, 22, 26 to the center thereof.

Another form of intraspacial member is shown as a pair of wedge brace panel members 60 which are angularly positioned on either side of and supported against the respective sloped web panel members 50. Each wedge brace panel member 60 includes an upper edge 64 which abuts against and is fastened to the respective side panels 16, 20, 24 and 28 and a side edge 62 which abuts against the respective (even numbered) pentagonal panel members 38–44.

It should thus be apparent that the aforementioned bevel angle panel members 46*a*, 46*b*, sloped web panel members 50, and wedge brace panel members 60 are appropriately affixed to both the (even numbered) exterior panels 12–28 and the (even numbered) interior panels 30–44 as illustrated in the drawings. The exterior panels are structurally interdependent upon the respectively corresponding interior panels. Furthermore, an intraspacial area 65 between the interior and exterior panels can be functionally employed for additional occupancy, insulation, utilities, storage or for other similar purposes.

A further aspect of this invention includes the optional interconnection of two adjacent exterior panels with two adjacent interior panels at selected locations and for this purpose a chock 66 is utilized. In this preferred embodiment the chock 66 is positioned at four of the possible locations as shown in FIG. 2 and provides a support coupling between the roof panel 12 and the respective side panels 14, 18, 22 and 26 and also interconnects the rhombic panels 30, 32, 34 and 36. For the purpose of illustration, FIG. 6 shows the rhombus panel 30 with the chock 66 displaced. It should be noted that the chock 66 is provided with an upper surface 68 defining a dihedral angle corresponding to the angular displacement between the roof panel 12 and respective side panels 14, 18, 22 and 26. A lower surface 70 of the chock 66 has a dihedral angle which extends normally to that of the upper surface 68 and corresponds to the angular orientation of the adjacent rhombus panels over which it is seated. The application of the optional chock 66 is further illustrated in FIG. 1.

Although this invention was described with reference to the tessellation of hemispherical surface, it should be noted that the concept is applicable to ellipsoids, hyperbolic paraboloids, hyperboloids, elliptic paraboloids, quadric cones, toroids, cylinders, conoids, and other surfaces of rotation or portions thereof. Furthermore, the concept is also applicable with more than two polyhedral surfaces.

It should thus be apparent that there is provided a space frame construction with mutually dependent surfaces which achieves the various objects of this invention and which is well adapted to meet conditions of practical use.

Since various possible embodiments might be made of the present invention and various changes might be made in the exemplary embodiments set forth, it is to be understood that all materials shown and described in the accompanying drawings are to be interpreted as illustrative and not in a limiting sense.

Having thus described the invention, there is claimed as new and desired to be secured by Letters Patent:

1. A space frame construction with at least two mutually dependent surfaces comprising at least one multifaceted surface formed by a plurality of rigid panel members approximating a tessellation of a generating curved surface and defining a first polyhedron normally projected above the generating curved surface, said first polyhedron enclosing an open space thereunder, a second complementary multifaceted surface formed by a plurality of rigid panel members approximating another generating curved surface and defining a second polyhedron in duality with the first polyhedron, with the rigid panel members of each of said polyhedra being disjoined and intraspacial means in mutual contact with the first and second polyhedra for providing structural interconnection to support the space frame.

2. A space frame as claimed in claim 1 wherein the intraspacial means comprise a plurality of connecting members, said connecting members each having an edge surface confronting an inner surface of the first polyhedron and another edge surface confronting an outer surface of the second polyhedron.

3. A space frame construction as claimed in claim 1 wherein the panels of said first polyhedron include a rectangular roof panel and noncontiguous triangular side panel members.

4. A space frame construction as claimed in claim 3 wherein the panels of said second polyhedron are in corresponding duality with the roof and side panel members of said first polyhedron and include a rhombic panel member positioned above an intraspacial pentagonal side panel member.

5. A space frame construction as claimed in claim 1 wherein the intraspacial means include a bevel angle panel member, said bevel angle panel member being positioned on the rhombic panel member and lying coincident to the diagonal of the rhombic panel member.

6. A space frame construction as claimed in claim 5 wherein each bevel angle panel member has an inclined surface sloping from a maximum height above the center of the rhombic panel to a minimum height at a corner of the panel with said inclined surface being respectively contiguous to the roof panel and the side panels of the first polyhedron to provide mutual support.

7. A space frame construction as claimed in claim 1 wherein the intraspacial means includes at least one sloped web panel member, said web panel member lying between and interconnecting corresponding panel members of said first and second polyhedra.

8. A space frame construction as claimed in claim 7 further including a wedge brace panel member, said wedge brace panel member being positioned adjacent the web panel member, the pentagonal side panel member and the triangular side panel member of the first polyhedron.

9. A space frame construction as claimed in claim 1 further including a chock, said chock being positioned between two panel members of the second polyhedron and adapted to support two panel members of the first polyhedron.

* * * * *